US007455036B2

(12) United States Patent
Nishikawa et al.

(10) Patent No.: US 7,455,036 B2
(45) Date of Patent: Nov. 25, 2008

(54) COMBUSTION TYPE POWER TOOL HAVING FIN IN LOW TURBULENT COMBUSTION REGION WITHIN COMBUSTION CHAMBER

(75) Inventors: Tomomasa Nishikawa, Hitachinaka (JP); Yoshitaka Akiba, Hitachinaka (JP); Haruhisa Fujisawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/448,756

(22) Filed: Jun. 8, 2006

(65) Prior Publication Data

US 2006/0225675 A1 Oct. 12, 2006

Related U.S. Application Data

(63) Continuation of application No. 11/121,017, filed on May 4, 2005, now Pat. No. 7,063,052.

(30) Foreign Application Priority Data

May 7, 2004 (JP) ..... P2004-138854
Mar. 30, 2005 (JP) ..... P2005-098959

(51) Int. Cl.
*F02B 71/00* (2006.01)
*B25C 1/12* (2006.01)

(52) U.S. Cl. ..... 123/46 SC; 227/10

(58) Field of Classification Search ..... 123/46 R–46 H; 227/8, 10, 130

See application file for complete search history.

(56) References Cited

U.S. PATENT DOCUMENTS 4,522,162 A 6/1985 Nikolich
5,197,646 A 3/1993 Nikolich

FOREIGN PATENT DOCUMENTS

EP 1 388 394 2/2004
EP 1 543 926 6/2005

*Primary Examiner*—Noah Kamen
(74) *Attorney, Agent, or Firm*—Antonelli, Terry, Stout & Kraus, LLP.

(57) ABSTRACT

A combustion-type power tool includes a housing, a head portion, a cylinder disposed in the housing, and a push lever. A piston is reciprocally movable in the cylinder, and a combustion-chamber frame is disposed in the housing and abuttable on the head portion to provide a combustion chamber in cooperation with the head portion and the piston. A fuel supplying portion supplies the fuel into the combustion chamber, a motor is disposed at the head portion, and a fan is disposed in the combustion chamber and connected to an output shaft of the motor so as to promote turbulent combustion of an air-fuel mixture. The fan and the combustion-chamber frame define a high turbulent-combustion region and a low turbulent-combustion region, a fin of one shape is located within the low turbulent-combustion region, and another fin of another shape has a part thereof located in the high turbulent-combustion region.

6 Claims, 11 Drawing Sheets

COMBUSTION TYPE POWER TOOL HAVING FIN IN LOW TURBULENT COMBUSTION REGION WITHIN COMBUSTION CHAMBER

CROSS REFERENCE TO RELATED APPLICATION

This application is a continuation application of U.S. Ser. No. 11/121,017, filed May 4, 2005, the contents of which are incorporated herein by reference.

BACKGROUND OF THE INVENTION

1. Field of the Invention

The present invention relates to a combustion-type power tool, and more particularly, to a combustion-type fastener driving tool in which liquidized gas is ejected from a gas canister into a combustion chamber, mixed with air and ignited to drive a piston, thus generating power to drive nails or the like.

2. Description of Related Art

A conventional combustion-type driving tool generally includes a housing, a handle, a trigger switch, a head cap, a combustion-chamber frame, a push lever, a cylinder, a piston, a driver blade, a motor, a fan, a gas canister, an ignition plug, an exhaust-gas check valve, an exhaust cover, a magazine, and a tail cover. The head cap is disposed at one end of the housing and is formed with a combustible gas passage. The handle is fixed to the housing and is provided with the trigger switch. The combustion-chamber frame is movable in the housing in the lengthwise direction thereof. The combustion-chamber frame is urged in a direction away from the head cap by a spring, and one end of the combustion-chamber frame is abuttble on the head cap against the biasing force of the spring.

The push lever is movably provided at the other end of the housing and is coupled to the combustion-chamber frame. The cylinder is secured to the housing and in communication with the combustion-chamber frame. The cylinder guides the movement of the combustion-chamber frame and is formed with an exhaust port. The piston is reciprocally movable in the cylinder. While the combustion-chamber frame has its one end abutting on the head cap, the piston defines a combustion chamber in cooperation with the head cap, the combustion-chamber frame and the end portion of the cylinder, the end portion being positioned near the head cap. The driver blade extends from the end of the piston which faces away from the combustion chamber toward the other end of the housing.

The motor is supported on the head cap. The fan is fastened to the motor and provided in the combustion chamber. The fan mixes the combustible gas with air in the combustion chamber for promoting combustion. The fan also serves to introduce an external air into the housing when the combustion-chamber frame is moved away from the head cap for scavenging within the combustion-chamber frame, and at the same time serves to cool an outer peripheral side of the cylinder. The gas canister is assembleable in the housing and contains liquidized combustible gas that is to be ejected into the combustion chamber through a combustible gas passage formed in the head cap. The ignition plug is faced to the combustion chamber to ignite a mixture of combustible gas and air. The exhaust-gas check valve selectively closes the exhaust port. The exhaust cover covers the exhaust gas check valve for directing the exhaust gas in the axial direction of the tool.

The magazine is positioned at the other end of the housing and contains fastening elements such as nails. The tail cover is interposed between the magazine and the push lever to supply the fastener from the magazine to a position of a moving locus of the driver bit.

In order to provide a hermetic state of the combustion chamber when the combustion chamber frame is brought into abutment with the head cap, a seal member (seal ring) is provided at a predetermined position of the head cap for intimate contact with an upper portion of the combustion-chamber frame and another seal member (seal ring) is provided at the cylinder near the head cap for intimate contact with a lower portion of the combustion chamber frame.

Upon ON operation of the trigger switch while the push lever is pushed against a workpiece, combustible gas is ejected into the combustion chamber from the gas canister assembled in the housing. In the combustion chamber, the combustible gas and air are stirred and mixed together by the fan. The ignition plug ignites the resultant mixture gas. The mixture gas explodes to drive piston for driving the driver blade, which in turn drives nails into a workpiece such as a wood block. After explosion, the combustion chamber frame is maintained in its abutting position to the head cap while the trigger switch is in the ON state. During this abutting period, the exhaust gas check valve is closed when the combustion gas is exhausted and a pressure in the combustion chamber becomes lower than an atmospheric pressure to maintain closing state of the combustion chamber. Further, thermal vacuum is generated in the combustion chamber due to pressure drop caused by decrease in temperature. Therefore, the piston can be moved toward its upper dead center because of the pressure difference between upper and lower spaces of the cylinder with respect to the piston. Such conventional power tool is described in, for example, U.S. pat. Nos. 5,197,646 and 4,522,162.

SUMMARY OF THE INVENTION

In a combustion-type nail driver 801 shown in FIG. 13, a fan 14 and combustion-chamber fins 136 are provided in a combustion chamber 26. Following ignition by an ignition plug 15, the fan 14 promotes the stirring and mixing of air with combustible gas in the combustion chamber 26. At this time, a turbulent combustion (a combustion of mixture gas in a turbulent state) is generated rapidly in a high turbulent-combustion region H, thereby driving a piston 25 downward.

However, in the combustion-type nail driver 801, the combustion-chamber fins 136 protrude significantly into the high turbulent-combustion region H. In other words, the combustion-chamber fins 136 has a large surface area in the high turbulent-combustion region H. Thus the combustion-chamber fins 136 adversely cool (or draw heat from) combusted gas when the turbulent combustion is generated in the high turbulent-combustion region H. Therefore the combustion-chamber fins 136 hinder the mixture gas from combusting and expanding, resulting in a drop in drive energy.

The drop in drive energy could be reduced by not providing the combustion-chamber fins 136 or by decreasing the number of the combustion-chamber fins 136 to a minimal number. However, if the number of the combustion-chamber fins 136 is insufficient or if the combustion-chamber fins 136 are not provided at all, sufficient thermal vacuum is not generated or, in a worse case, the thermal vacuum is not generated at all. In such a situation, the piston 25 cannot be moved back to the initial top dead center in a cylinder 20. In addition, if the number of the combustion-chamber fins 136 is insufficient or if the surface area of the combustion-chamber fins 136 is not sufficiently large, a temperature of the combustion-type nail driver 801 increases as nail driving operations continue.

When the temperature becomes excessively high, again, the piston 25 cannot be moved back to the initial top dead center in the cylinder 20.

As described above, the drop in drive energy is caused when the number of the combustion-chamber fins 136 is too many or when the combustion-chamber fins 136 has an excessively large surface area in the high turbulent-combustion region H. On the other hand, the piston 25 cannot be moved back to the initial position when the number of the combustion-chamber fins 136 is insufficient or when the combustion-chamber fins 136 do not have a sufficiently large surface area.

In view of the above-described drawbacks, it is an objective of the present invention to provide a combustion-type power tool which can reduce a drop in drive energy and can move a piston back to an initial position reliably.

In order to attain the above and other objects, the present invention provides a combustion-type power tool. The combustion-type power tool includes a housing, a head portion, a cylinder, a push lever, a piston, a combustion-chamber frame, a fuel supplying portion, a motor, a fan, and a fin. The housing has one end and another end and defines a longitudinal direction. The head portion is disposed at the one end and is formed with a fuel passage. The cylinder is disposed in and is fixed to the housing. The push lever is disposed at the another end and is movable in the longitudinal direction when pressure contacting a workpiece. The piston is reciprocally movable in the longitudinal direction and is slidable relative to the cylinder. The piston divides the cylinder into an upper space above the piston and a lower space below the piston. The combustion-chamber frame is disposed in the housing and is movable in the longitudinal direction in interlocking relation to the push lever. The combustion-chamber frame is abuttable on the head portion to provide a combustion chamber in cooperation with the head portion and the piston. The fuel supplying portion contains fuel and supplies the fuel into the combustion chamber through the fuel passage, thereby providing air-fuel mixture in the combustion chamber. The motor includes a motor case disposed at the head portion and an output shaft extending from the motor case and protruding into the combustion chamber. The fan is disposed in the combustion chamber and is connected to the output shaft so as to be rotatable with the output shaft for promoting turbulent combustion of the air-fuel mixture. The fan and the combustion-chamber frame define, within the combustion chamber, a high turbulent-combustion region in which the turbulent combustion is rapidly generated and a low turbulent-combustion region outside the high turbulent-combustion region. The fin is disposed at at least one of the combustion-chamber frame, the head portion, and the piston to protrude into the combustion chamber. The fin is located within the low turbulent-combustion region.

The present invention also provides a combustion-type power tool. The combustion-type power tool includes a housing, a head portion, a cylinder, a push lever, a piston, a combustion-chamber frame, a fuel supplying portion, a motor, a fan, a fin, and another fin. The housing has one end and another end and defines a longitudinal direction. The head portion is disposed at the one end and is formed with a fuel passage. The cylinder is disposed in and is fixed to the housing. The push lever is disposed at the another end and is movable in the longitudinal direction when pressure contacting a workpiece. The piston is reciprocally movable in the longitudinal direction and is slidable relative to the cylinder. The piston divides the cylinder into an upper space above the piston and a lower space below the piston. The combustion-chamber frame is disposed in the housing and is movable in the longitudinal direction in interlocking relation to the push lever. The combustion-chamber frame is abuttable on the head portion to provide a combustion chamber in cooperation with the head portion and the piston. The fuel supplying portion contains fuel and supplies the fuel into the combustion chamber through the fuel passage, thereby providing air-fuel mixture in the combustion chamber. The motor includes a motor case disposed at the head portion and an output shaft extending from the motor case and protruding into the combustion chamber. The fan is disposed in the combustion chamber and is connected to the output shaft so as to be rotatable with the output shaft for promoting turbulent combustion of the air-fuel mixture. The fan and the combustion-chamber frame define, within the combustion chamber, a high turbulent-combustion region in which the turbulent combustion is rapidly generated and a low turbulent-combustion region outside the high turbulent-combustion region. The fin has one shape and is disposed at at least one of the combustion-chamber frame, the head portion, and the piston to protrude into the combustion chamber. An entirety of the fin is located within the low turbulent-combustion region. The another fin has another shape different from the one shape. At least part of the another fin is located in the high turbulent-combustion region.

DETAILED DESCRIPTION OF THE PREFERRED EMBODIMENTS

Figure 1:
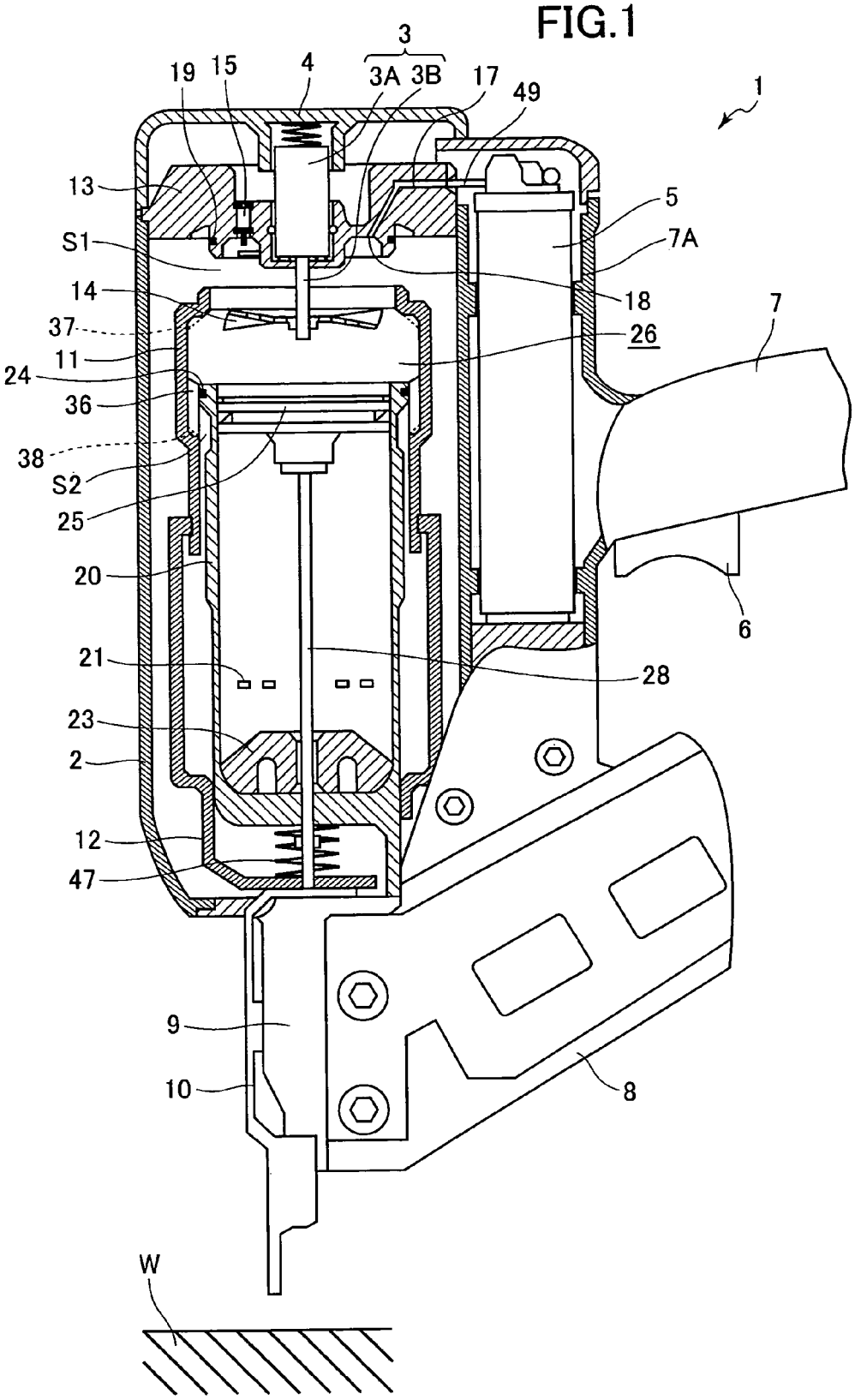
FIG. 1 is a vertical cross-sectional view showing a combustion-type nail driver embodying a combustion-type power tool according to a first embodiment of the present invention, in which a combustion-chamber frame is separated from a head cap.

A combustion-type power tool according to embodiments of the present invention will be described while referring to the accompanying drawings wherein like parts and components are designated by the same reference numerals to avoid duplicating description.

A combustion-type power tool according to a first embodiment of the present invention will be described with reference to FIGS. 1 through 5. The embodiment pertains to a combustion-type nail driver. The combustion-type nail driver 1 has a main housing 2 constituting an outer frame. The main housing 2 has a top portion provided with a head cover 4 in which an intake port is formed, and has a bottom portion formed with an exhaust port (not shown).

A handle 7 extends from a side of the main housing 2. The handle 7 includes a canister housing 7A juxtaposed to the main housing 2. A gas canister 5 containing therein a combustible liquefied gas is detachably disposed in the canister housing 7A. The handle 7 has a trigger switch 6. The handle 7 houses therein a battery for driving a motor 3 and an ignition plug 15 described later. A magazine 8 and a tail cover 9 are provided on the bottoms of the main housing 2 and canister housing 7A. The magazine 8 contains nails (not shown), and the tail cover 9 is adapted to guidingly feed each nail in the magazine 8 and set the nail to a predetermined position.

A push lever 10 is movably provided at the lower end of the main housing 2 and is positioned adjacent to a nail setting position defined by the tail cover 9. The push lever 10 is coupled to a coupling member 12 that is engaged with a combustion-chamber frame 11 which will be described later by a pin (not shown). When the entire housing 2 is pressed toward a workpiece W while the push lever 10 is in abutment with the workpiece W, an upper portion of the push lever 10 is retractable into the main housing 2.

A head cap 13 is secured to the main housing 2 and at a position below the head cover 4. The head cap 13 supports the motor 3 having a motor case 3A and a motor shaft 3B, and a fan 14 is coaxially fixed to the motor shaft 3B. The head cap 13 also supports the ignition plug 15 ignitable upon manipulation to the trigger switch 6. A head switch (not shown) is provided in the main housing 2 for detecting an uppermost stroke end position of the combustion chamber frame 11 when the power tool 1 is pressed against the workpiece W. Thus, the head switch can be turned ON when the push lever 10 is elevated to a predetermined position for starting rotation of the motor 3, thereby starting rotation of the fan 14. A temperature sensor (not shown) such as a thermistor, a thermo-couple, and a bimetal is attached to a wall of the combustion chamber frame 11 for detecting a temperature of the combustion chamber frame 11.

Figure 2:
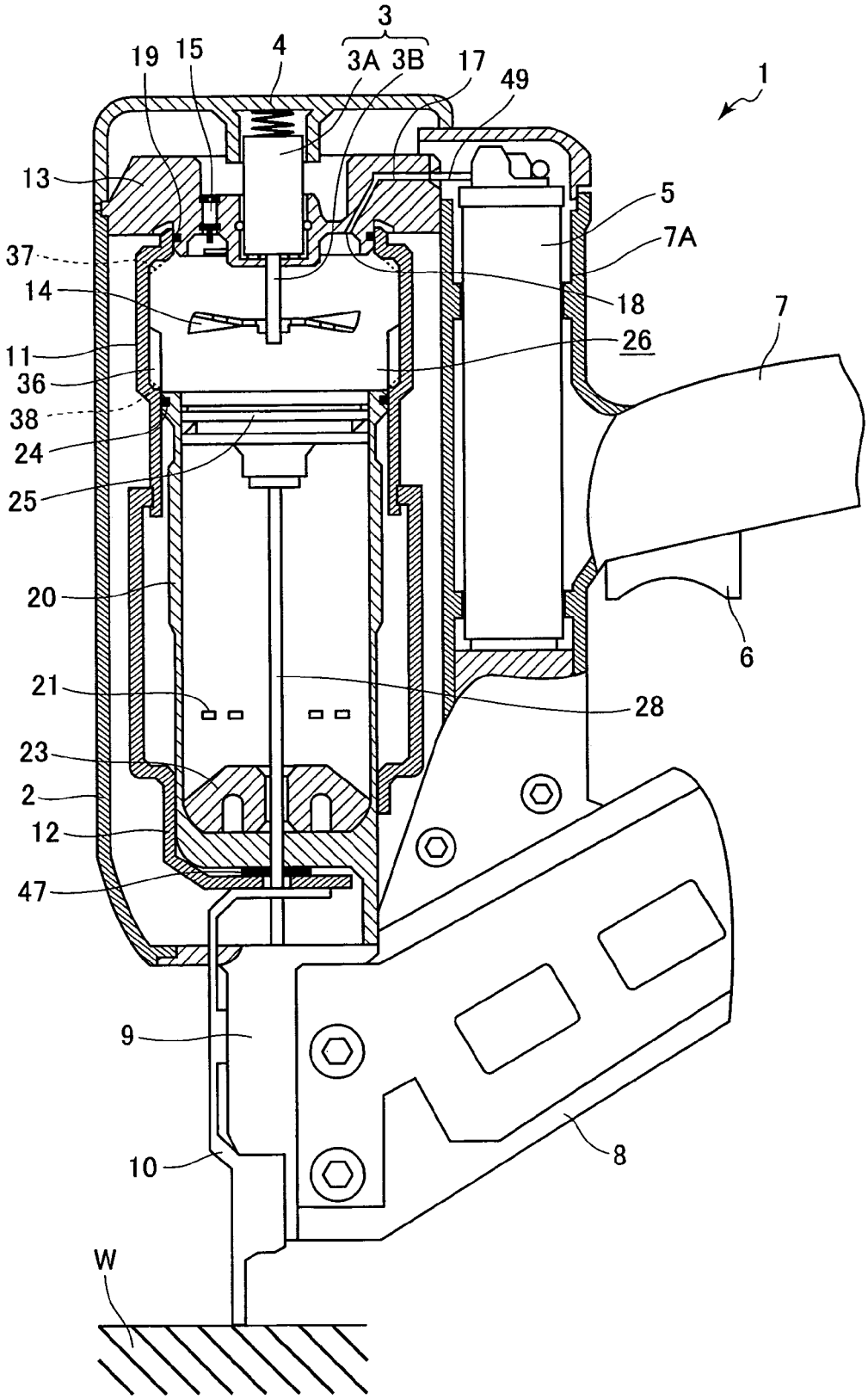
FIG. 2 is a vertical cross-sectional view showing the combustion-type nail driver according to the first embodiment, in which the combustion-chamber frame abuts on the head cap.

The head cap 13 has a canister housing side in which is formed a fuel ejection passage 17 which allows a combustible gas to pass therethrough. One end of the ejection passage 17 serves as an ejection port 18 that opens at the lower surface of the head cap 13. Another end of the ejection passage 17 is communicated with a gas canister 5 which will be described later. An O-ring 19 is installed in the head cap 13 for providing a seal between the head cap 13 and an upper end portion of the combustion-chamber frame 11 when the upper end of the combustion-chamber frame 11 abuts on the head cap 13 (FIG. 2). An injection rod 49 is provided at the gas canister 5 for providing a fluid communication between the gas canister 5 and the ejection passage 17.

The combustion-chamber frame 11 is provided in the main housing 2 and is movable in the lengthwise direction of the main housing 2. The uppermost end of the combustion-chamber frame 11 is abuttable on the lower surface of the head cap 13. The coupling member 12 described above is engaged with the lower end of the combustion-chamber frame 11 and is connected to the push lever 10. Therefore, the combustion chamber frame 11 is movable in interlocking relation to the push lever 10. A cylinder 20 is fixed to the main housing 2. The inner circumference of the combustion-chamber frame 11 is in sliding contact with an outer peripheral surface of the cylinder 20 for guiding the movement of the combustion-chamber frame 11. A compression coil spring 47 is interposed between the lower end of the cylinder 20 and the lower end of the coupling member 12 for biasing the combustion-chamber frame 11 in a direction away from the head cap 13. The cylinder 20 has a lower portion formed with an exhaust hole 21 in fluid communication with the above-mentioned exhaust port of the main housing 2. An exhaust-gas check valve (not shown) is provided to selectively close the exhaust hole 21. A bumper 23 is provided on the bottom of the cylinder 20. Another O-ring 24 is provided on the upper portion of the cylinder 20 to provide a seal between the inner circumference of the lower part of the combustion-chamber frame 11 and the outer circumference of the upper part of the cylinder 20 when the combustion-chamber frame 11 abuts on the head cap 13 (FIG. 2).

A piston 25 is slidably and reciprocally provided in the cylinder 20. When the upper end of the combustion-chamber frame 11 abuts on the head cap 13, the head cap 13, the combustion-chamber frame 11, the upper portion of the cylinder 20, the piston 25 and the O-rings 19 and 24 define a combustion chamber 26. As shown in FIG. 1, when the combustion chamber frame 11 is separated from the head cap 13, a first flow passage S1 in communication with the atmosphere is provided between the head cap 13 and the upper end of the combustion chamber frame 11, and a second flow passage S2 in communication with the first flow passage S1 is provided between the lower end portion of the combustion chamber frame 11 and the upper end portion of the cylinder 20. The second flow passage S2 allows a combustion gas and a fresh air to pass along the outer peripheral surface of the cylinder 20 for discharging these gas through the exhaust port of the main housing 2.

A plurality of combustion-chamber fins (ribs) 36 are provided on the inner peripheral portion of the combustion-chamber frame 11 which portion defines the combustion chamber 26. The combustion-chamber fins 36 extend in the lengthwise direction of the combustion chamber frame 11 and project radially inwardly toward the axis of the main housing 2. The above-mentioned intake port (not shown) is adapted to supply air into the combustion chamber 26, and the exhaust hole 21 and the exhaust port are adapted to exhaust the combusted gas from the combustion chamber 26.

As shown in FIG. 1, when the combustion-type nail driver 1 is lifted from the workpiece W and the combustion-chamber frame 11 is separated from the head cap 13, the combustion-chamber fins 36 also function as a holding mechanism for holding the O-ring 24 at its right position near the upper end of the cylinder 20. In the present embodiment, a plurality of upper fins 37 and a plurality of lower fins 38 to be described later are also provided at the combustion-chamber frame 11, in addition to the combustion-chamber fins 36.

A driver blade 28 extends downwards from a side of the piston 25, the side being opposite to the combustion chamber 26 to the lower end of the main housing 2. The driver blade 28 is positioned coaxially with the nail setting position in the tail cover 9, so that the driver blade 28 can strike against the nail. When the piston 25 moves downward, the piston 25 abuts on the bumper 23 and stops.

The fan 14 is provided in the combustion chamber 26, and the ignition plug 15 and the ejection port 18 are respectively exposed and open to the combustion chamber 26. Rotation of the fan 14 performs the following three functions. First, the fan 14 stirs and mixes the air with the combustible gas as long as the combustion-chamber frame 11 remains in abutment with the head cap 13. Second, after the mixed gas has been ignited, the fan 14 causes turbulence of the air-fuel mixture, thus promoting the combustion of the air-fuel mixture in the combustion chamber 26. Third, the fan 14 performs scavenging such that the exhaust gas in the combustion chamber 26 can be scavenged therefrom and also performs cooling to the combustion chamber frame 11 and the cylinder 20 when the combustion-chamber frame 11 moves away from the head cap 13 and when the first and second flow passages S1, S2 are provided (FIG. 1).

Figure 3:
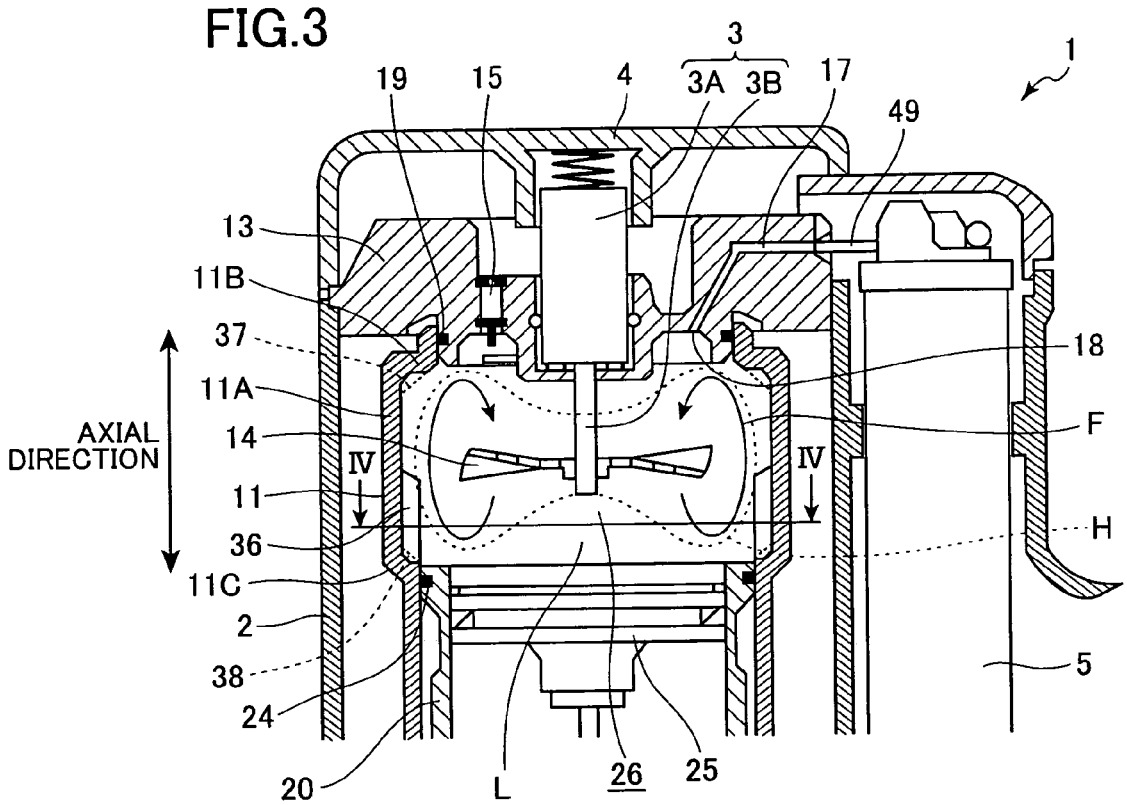
FIG. 3 is an enlarged vertical cross-sectional view showing the combustion-type nail driver according to the first embodiment.
Figure 4:
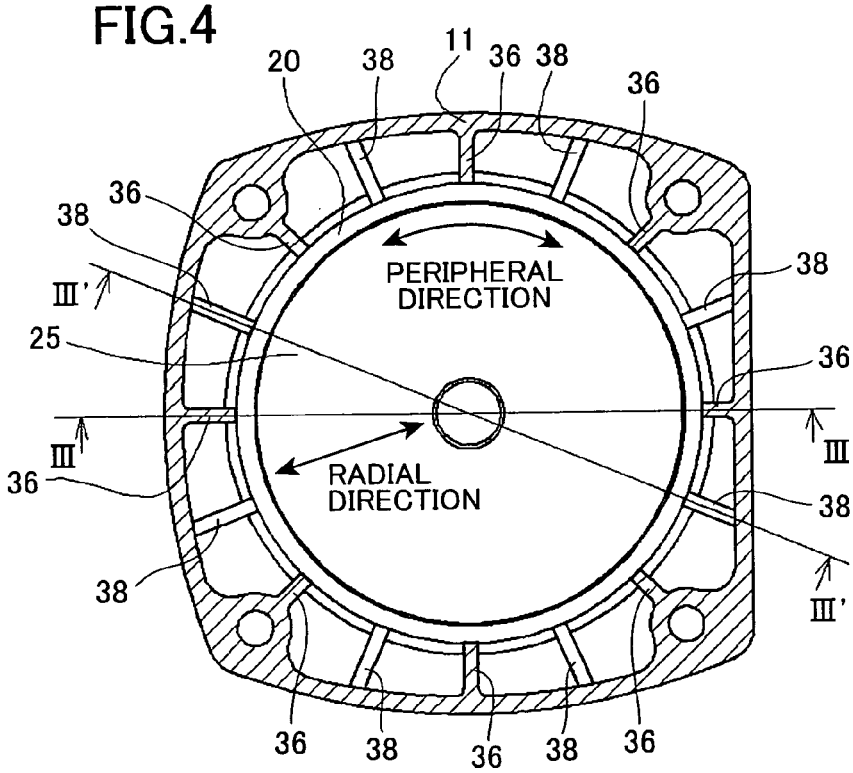
FIG. 4 is a horizontal cross-sectional view taken along a line IV-IV of FIG. 3 for particularly showing combustion-chamber fins and lower fins.

The combustion-chamber fins 36, the upper fins 37, and the lower fins 38 will be described in greater detail with reference to FIGS. 3 and 4. FIG. 3 is a vertical cross-sectional view taken along a line III-III of FIG. 4, and FIG. 4 is a horizontal cross-sectional view taken along a line IV-IV of FIG. 3. Note that in FIG. 3 the upper fins 37 and the lower fins 38 are shown in dotted lines because the upper fins 37 and the lower fins 38 are located on a line III'-III ' of FIG. 4.

Figure 13:
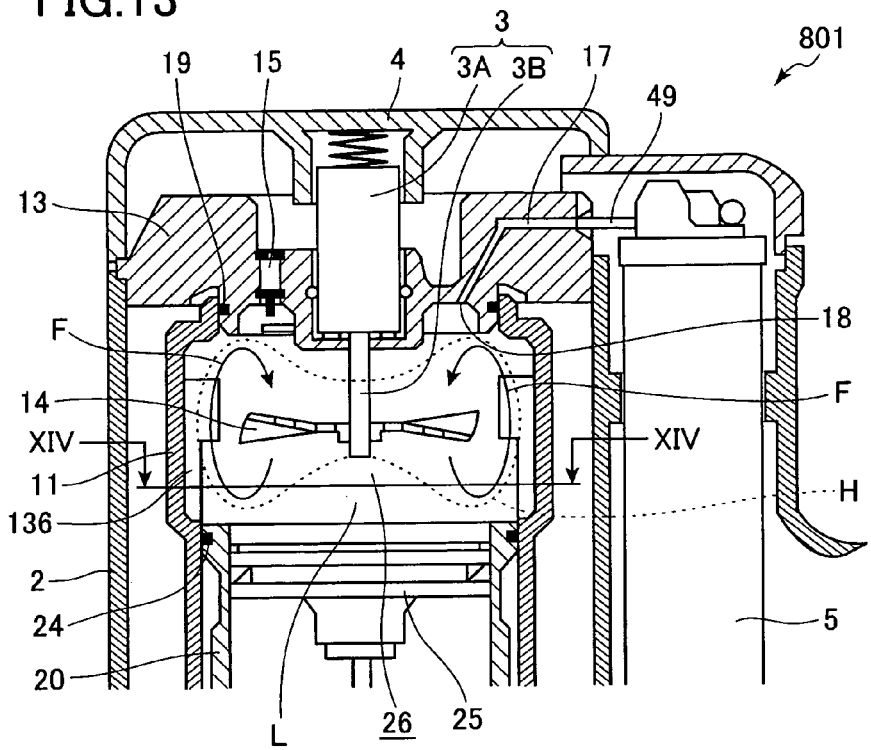
FIG. 13 is a vertical cross-sectional view partially showing a conventional combustion-type nail driver.
Figure 14:
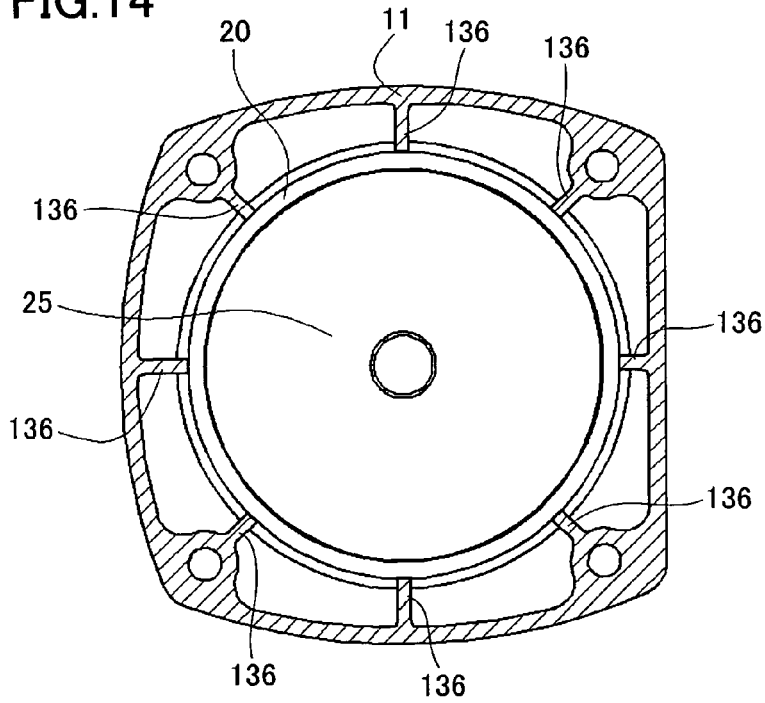
FIG. 14 is a horizontal cross-sectional view taken along a line XIV-XIV of FIG. 13.

As shown in FIGS. 3 and 4, the combustion-chamber frame 11 includes a peripheral wall 11A, an upper wall 11B, and a lower wall 11C. The peripheral wall 11A extends in a peripheral direction and defines the combustion chamber 26. The upper wall 11B is joined to the peripheral wall 11A at an upper side, i.e., a side at which the head cap 13 is located. The lower wall 11C is joined to the peripheral wall 11A at a lower side, i.e., a side at which the push lever 10 is located. The combustion-chamber fins 36 are smaller in size than the conventional fins 136 (FIGS. 13 and 14) both in the axial direction and in the radial direction of the combustion-chamber frame 11, and thus have smaller cooling capacity. Each upper fin 37 is provided at a joining portion between the peripheral wall 11A and the upper wall 11B. Each lower fin 38 is provided at a joining portion between the peripheral wall 11A and the lower wall 11C. As shown in FIG. 4, the lower fins 38 are positioned between the combustion-chamber fins 36 in the peripheral direction. The upper fins 37 are positioned at the same positions as the lower fins 38 in the peripheral direction. In the present embodiment, each upper fin 37 has an edge extending in a direction having an approximately 45-degree angle with respect to the axial direction and extending between the peripheral wall 11A and the upper wall 11B. Similarly, each lower fin 38 has an edge extending in another direction also having an approximately 45-degree angle with respect to the axial direction and extending between the peripheral wall 11A and the lower wall 11C. As shown in FIG. 3, the upper fins 37 and lower fins 38 are smaller in size than the combustion-chamber fins 36 in the axial direction. As shown in FIGS. 3 and 4, the upper fins 37 and lower fins 38 have substantially a same size as the combustion-chamber fins 36 in the radial direction.

As shown in FIG. 3, the fan 14 and the combustion-chamber frame 11 define, within the combustion chamber 26, a high turbulent-combustion region H in which the turbulent combustion is rapidly generated and a low turbulent-combustion region L outside the high turbulent-combustion region H. The turbulent combustion is rapidly generated in the high turbulent-combustion region H by the ignition of the ignition plug 15 and the stirring of the fan 14, and subsequently expands to the low turbulent-combustion region L. That is, the turbulent combustion arrives in the low turbulent-combustion region L later than the high turbulent-combustion region H. As shown in FIG. 3, the upper fins 37 and lower fins 38 are located within the low turbulent-combustion region L. In other words, an entirety of each upper fin 37 and each lower fin 38 is located within the low turbulent-combustion region L. On the other hand, a part of each combustion-chamber fin 36 is located in the high turbulent-combustion region H.

Operation of the combustion type driving tool 1 according to the first embodiment will next be described with reference to FIGS. 1 through 5. As shown in FIG. 1, in the non-operational state of the combustion-type nail driver 1, the push lever 10 is biased downward by the biasing force of the compression coil spring 47, so that the push lever 10 protrudes from the lower end of the tail cover 9. Thus, the uppermost end of the combustion-chamber frame 11 is spaced away from the head cap 13 because the coupling member 12 couples the combustion-chamber frame 11 to the push lever 10. Further, a part of the combustion-chamber frame 11 which part defines the combustion chamber 26 is also spaced from the top portion of the cylinder 20. Hence, the first and second flow passages S1 and S2 are provided. In this condition, the piston 25 stays at the top dead center in the cylinder 20.

With this state, as shown in FIG. 2, if the push lever 10 is pushed onto the workpiece W such as a wood block while holding the handle 7 by a user, the push lever 10 is moved upward against the biasing force of the compression coil spring 47. At the same time, the combustion-chamber frame 11 which is coupled to the push lever 10, is also moved upward, closing the above-described flow passages S1 and S2. Thus, the sealed combustion chamber 26 is provided by the seal members 19 and 24.

In accordance with the movement of the push lever 10, the gas canister 5 is tilted toward the head cap 13 by an action of a cam (not shown). Thus, the injection rod 49 is pressed against the connecting portion of the head cap 13. Therefore, the liquidized gas is ejected once into the combustion chamber 26 through the ejection port 18.

Further, in accordance with the movement of the push lever 10, the combustion chamber frame 11 reaches the uppermost stroke end whereupon the head switch (not shown) is turned ON to start rotation of the fan 14. Rotation of the fan 14 and the combustion-chamber fins 36 protruding into the combustion chamber 26 cooperate, stirring and mixing the combustible gas with air in the combustion chamber 26.

Upon turning ON the trigger switch 6 at the handle 7, the ignition plug 15 generates a spark, which ignites the gas mixture. At this time, the fan 14 keeps rotating, promoting the turbulent combustion of the gas mixture. This enhances the output of the power tool. The combusted and expanded gas pushes the piston 25 downward. Therefore, a nail in the tail cover 9 is driven into the workpiece W through the driver blade 28 until the piston 25 abuts on the bumper 23.

As the piston 25 passes by the exhaust hole 21 of the cylinder 20, the check valve (not shown) opens the exhaust hole 21 because of the application of the combustion gas pressure to the check valve. Therefore the combustion gas is discharged from the cylinder 20 through the exhaust hole 21 and then discharged outside through the exhaust port of the main housing 2. The check valve is closed when the pressure in the cylinder 20 and combustion chamber 26 is restored to the atmospheric pressure as a result of the discharge. Combustion gas still remaining in the cylinder 20 and the combustion chamber 26 has a high temperature at a phase immediately after the combustion. However, the high temperature can be absorbed into the combustion-chamber fins 36, the upper fins 37, and the lower fins 38 as well as the walls of the cylinder 20 and the combustion-chamber frame 11 to rapidly cool the combustion gas. Thus, the pressure in the sealed space in the cylinder 20 above the piston 25 further drops to less than the atmospheric pressure (creating a so-called "thermal vacuum"). Accordingly, the piston 25 is moved back to the initial top dead center in the cylinder 20 by virtue of the pressure difference between the internal pressure in the combustion chamber 26 and the pressure in the lower part of the cylinder 20 lower than the piston 25.

In the present embodiment, in order to positively generate the thermal vacuum, the uppermost stroke end position of the combustion chamber frame 11 is maintained unchanged so as to avoid formation of the flow passages S1 and S2 in spite of the separation of the lower end of the push lever 10 from the workpiece W due to reaction force inevitably accompanied by the nail driving operation. In the present embodiment, communication of the combustion chamber 26 with the atmosphere is prohibited as long as ON state of the trigger switch 6 is maintained.

Then, the user lifts the combustion-type nail driver 1 from the workpiece W for separating the push lever 10 from the workpiece W, and turns off the trigger switch 6. As a result, the push lever 10 and the combustion-chamber frame 11 move downward due to the biasing force of the compression coil spring 47. Therefore, the flow passages S1 and S2 are provided again. At this time, a controller (not shown) controls the fan 14 to keep rotating for a predetermined time period after turning OFF the trigger switch 6. Hence fresh air can be introduced into the combustion chamber 26 through the intake port of the main housing 2 and through the flow passages S1, S2, and combustion gas is discharged through the exhaust port of the main housing 2 to perform scavenging to the combustion chamber 26. Then, the rotation of the fan 14 is stopped to recover the initial rest position.

With the above-described construction, an area of the combustion-chamber fins 36 can be reduced in the high turbulent-combustion region H in which the turbulent combustion is generated rapidly. Therefore, the combustion-chamber fins 36 do not prevent the gas mixture from combusting and expanding, thereby suppressing a drop in drive energy. Following the turbulent combustion in the high turbulent-combustion region H, the combusted gas expands to the low turbulent-combustion region L and arrives at the upper fins 37 and the lower fins 38. Since the combusted gas is cooled effectively by the upper fins 37 and the lower fins 38, sufficient thermal vacuum can be generated and thus the piston 25 can be moved back to the initial top dead center in the cylinder 20.

As described above, since the upper fins 37 and the lower fins 38 are provided in the low turbulent-combustion region L, it is both possible to generate sufficient energy to drive nails and to move back the piston 25 reliably to the initial top dead center.

Figure 5:
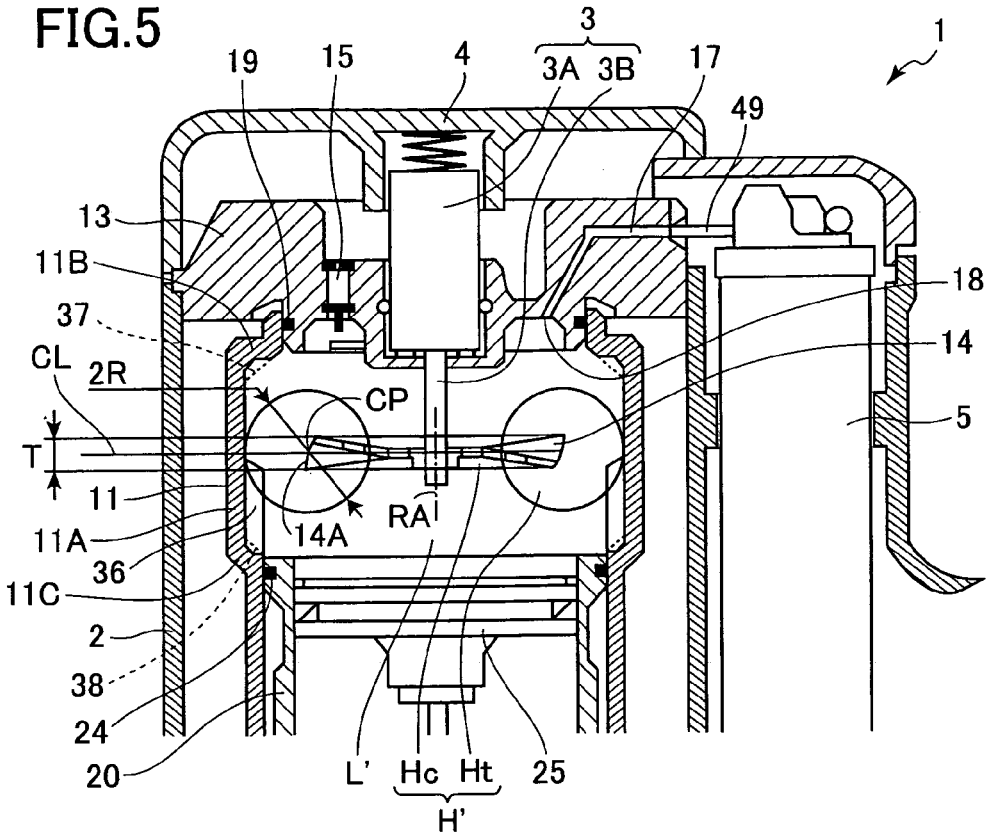
FIG. 5 is a vertical cross-sectional view showing a simplified representation of a high turbulent-combustion region in a combustion chamber of the combustion-type nail driver according to the first embodiment.

High and low turbulent-combustion regions will be described in greater detail with reference to FIG. 5. Experiments show that the above-described high turbulent-combustion region H is approximately represented by a high turbulent-combustion region H' shown in FIG. 5. That is, the high turbulent-combustion region H' is a simplified representation of the high turbulent-combustion region H. As shown in FIG. 5, the high turbulent-combustion region H' is defined as a combination of a ring torus region Ht and a cylindrical region Hc. The ring torus region Ht is formed by rotating, about an imaginary rotational axis RA of the fan 14, a circle having a center CP at an outer radial end of the fan 14 and having a radius R which is a distance between the outer radial end and an inner peripheral surface of the peripheral wall 11A. The center CP of the circle is, more specifically, positioned at an intersection of a center line CL and an outer radial edge 14A of the fan 14, the center line CL being central in a maximum height T of the fan 14. The cylindrical region Hc has a diameter equal to the diameter of the fan 14 and has a height equal to the maximum height T of the fan 14. The maximum height T is defined in the axial direction of the fan 14.

As shown in FIG. 5, a part of the combustion-chamber fins 36 are located within the high turbulent-combustion region H' when the combustion-chamber frame 11 is positioned in the top dead center.

As described earlier, when the combustion-type nail driver 1 is lifted from the workpiece W and the combustion-chamber frame 11 is separated from the head cap 13 (FIG. 1), the combustion-chamber fins 36 function as the holding mechanism for holding the O-ring 24 at its right position near the upper end of the cylinder 20. The combustion-chamber fins 36 need to have a desired size in order to hold the O-ring 24. On the other hand, the part of the combustion-chamber fins 36 located within the high turbulent-combustion region H should be as small as possible in order to suppress the drop in drive energy. To meet these two requirements, the combustion-chamber fins 36 have a height (a size in the radial direction) which does not exceed the outer periphery of the cylinder 20. The combustion-chamber fins 36 also have a length (a size in the axial direction) such that the combustion-chamber fins 36 can abut the O-ring 24 when the combustion-chamber frame 11 is positioned at the bottom dead center (FIG. 1).

Further, since the upper fins 37 and the lower fins 38 are provided in the low turbulent-combustion region L or L', reduction in the surface area of the combustion-chamber fins 36 can be compensated and thus the cylinder 20 can be cooled sufficiently to move the piston 25 back to its top dead center.

Figure 6:
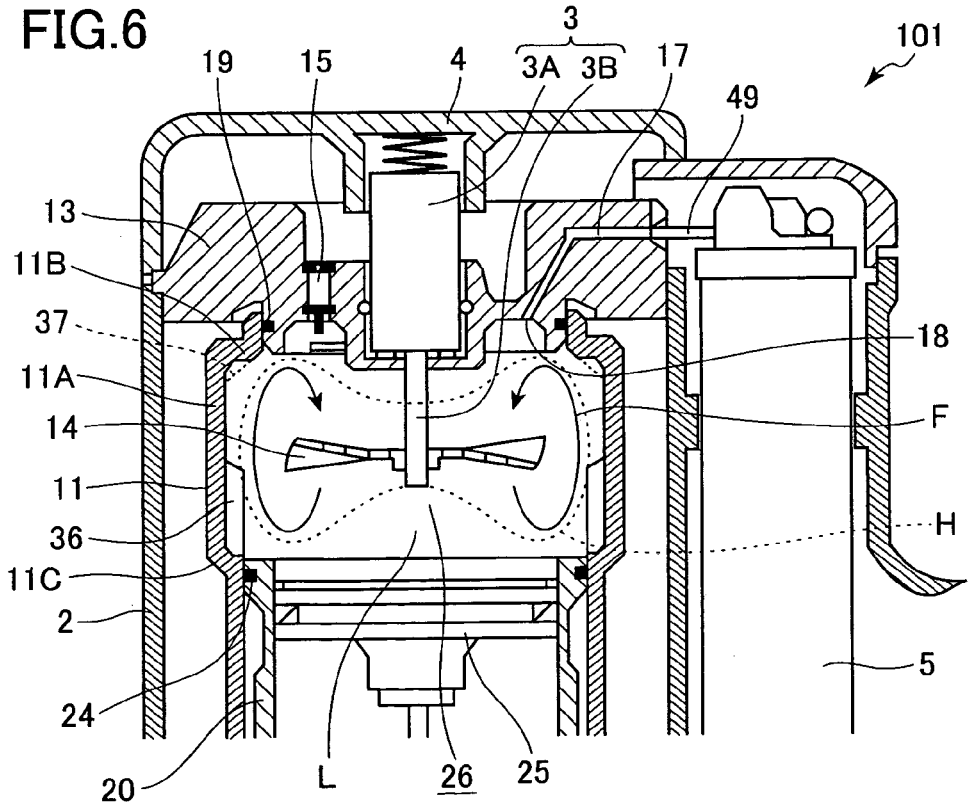
FIG. 6 is a vertical cross-sectional view showing a combustion-type nail driver embodying a combustion-type power tool according to a second embodiment of the present invention.

A combustion-type power tool according to a second embodiment of the present invention will be described with reference to FIG. 6. As shown in FIG. 6, a combustion-type nail driver 101 according to the second embodiment has the combustion-chamber fins 36 and the upper fins 37, but does not have the lower fins 38.

Figure 7:
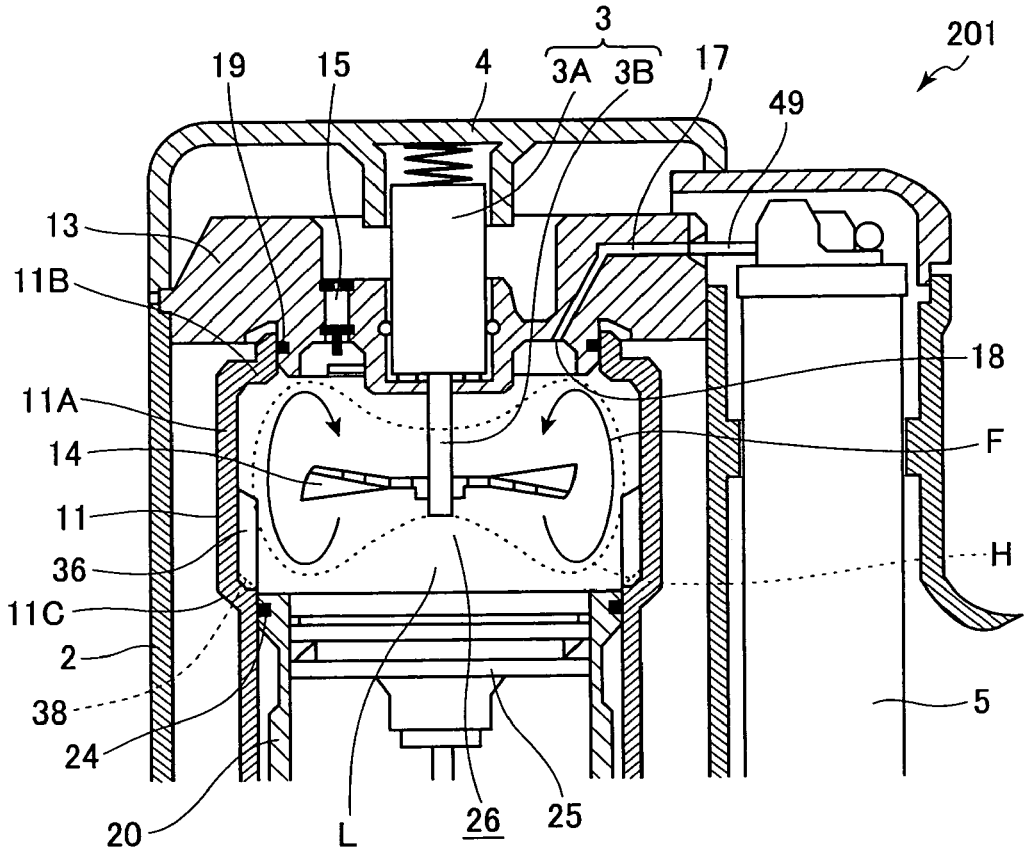
FIG. 7 is a vertical cross-sectional view showing a combustion-type nail driver embodying a combustion-type power tool according to a third embodiment of the present invention.

A combustion-type power tool according to a third embodiment of the present invention will be described with reference to FIG. 7. As shown in FIG. 7, a combustion-type nail driver 201 according to the third embodiment has the combustion-chamber fins 36 and the lower fins 38, but does not have the upper fins 37.

Figure 8A:
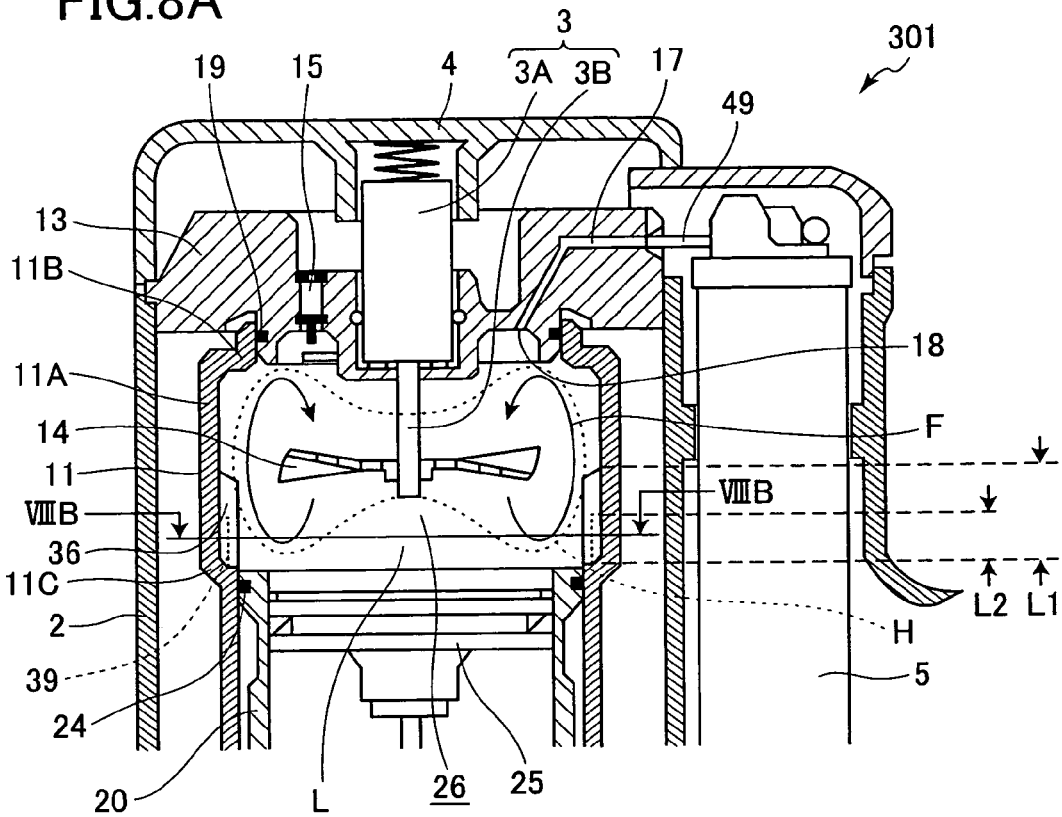
FIG. 8A is a vertical cross-sectional view showing a combustion-type nail driver embodying a combustion-type power tool according to a fourth embodiment of the present invention.
Figure 8B:
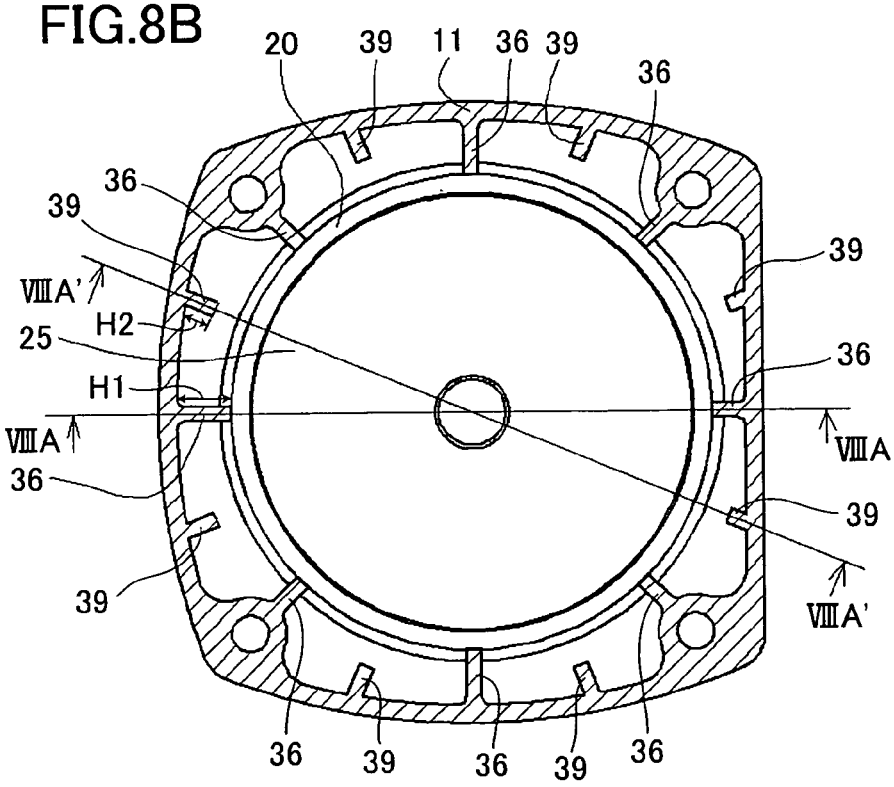
FIG. 8B is a horizontal cross-sectional view taken along a line VIIIB-VIIIB of FIG. 8A for particularly showing the combustion-chamber fins and piston-returning fins.

A combustion-type power tool according to a fourth embodiment of the present invention will be described with reference to FIGS. 8A and 8B. A combustion-type nail driver 301 according to the fourth embodiment has piston-returning fins 39 in addition to the combustion-chamber fins 36. FIG. 8A is a vertical cross-sectional view taken along a line VIIIA-VIIIA of FIG. 8B, and FIG. 8B is a horizontal cross-sectional view taken along a line VIIIB-VIIIB of FIG. 8A. Note that in FIG. 8A the piston-returning fins 39 are shown in dotted lines because the piston-returning fins 39 are located on a line VIIIA'-VIIIA' of FIG. 8B. As shown in FIGS. 8A and 8B, the combustion-chamber fin 36 has a height H1 (FIG. 8B) which is defined in the radial direction of the cylinder 20. The piston-returning fin 39 has a height H2 which is smaller than the height H1. The combustion-chamber fin 36 has a length L1 (FIG. 8A) which is defined in the axial (longitudinal) direction of the cylinder 20. The piston-returning fin 39 has a length L2 which is smaller than the length L1. Hence, the piston-returning fins 39 has the height and length both smaller than the combustion-chamber fins 36, such that the piston-returning fins 39 are located in the low turbulent-combustion region L. Thus the piston 25 can be moved back to the initial top dead center in the cylinder 20.

Figure 9A:
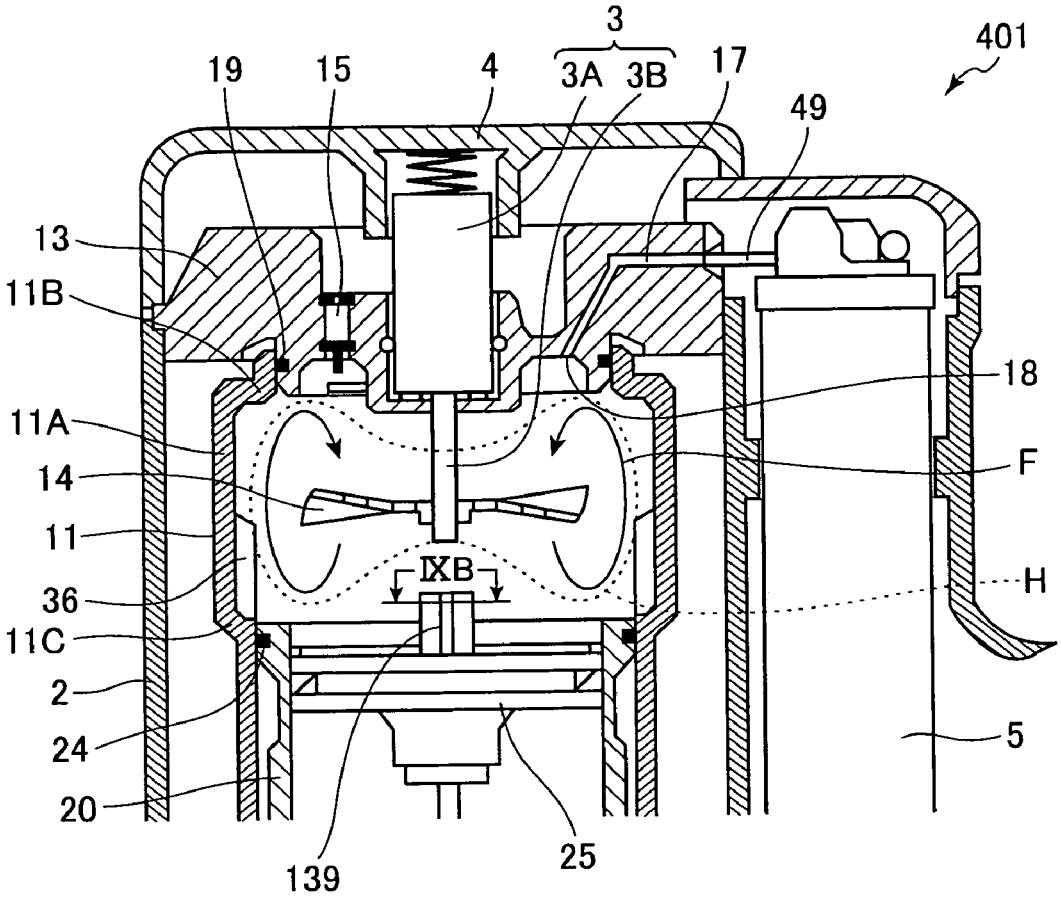
FIG. 9A is a vertical cross-sectional view showing a combustion-type nail driver embodying a combustion-type power tool according to a fifth embodiment of the present invention.
Figure 9B:
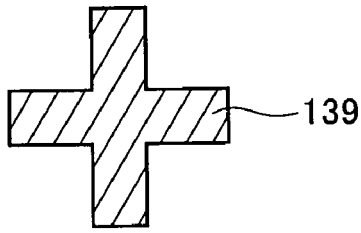
FIG. 9B is a horizontal cross-sectional view taken along a line IXB-IXB of FIG. 9A for particularly showing a shape of a piston-returning fin.

A combustion-type power tool according to a fifth embodiment of the present invention will be described with reference to FIGS. 9A and 9B. As shown in FIGS. 9A and 9B, a combustion-type nail driver 401 according to the fifth embodiment has a piston-returning fin 139. As shown in FIG. 9A, the piston-returning fin 139 is disposed at the piston 25 to protrude into the combustion chamber 26. In the present embodiment, the piston-returning fin 139 is formed integrally with the piston 25. The piston-returning fin 139 is located within the low turbulent-combustion region L. In other words, an entirety of the piston-returning fin 139 is located within the low turbulent-combustion region L. As shown in FIG. 9B, the piston-returning fin 139 has a cross shape in cross-section. This shape is effective in improving cooling efficiency. Obviously, the shape of the piston-returning fin 139 is not limited to the cross-shape.

Figure 10A:
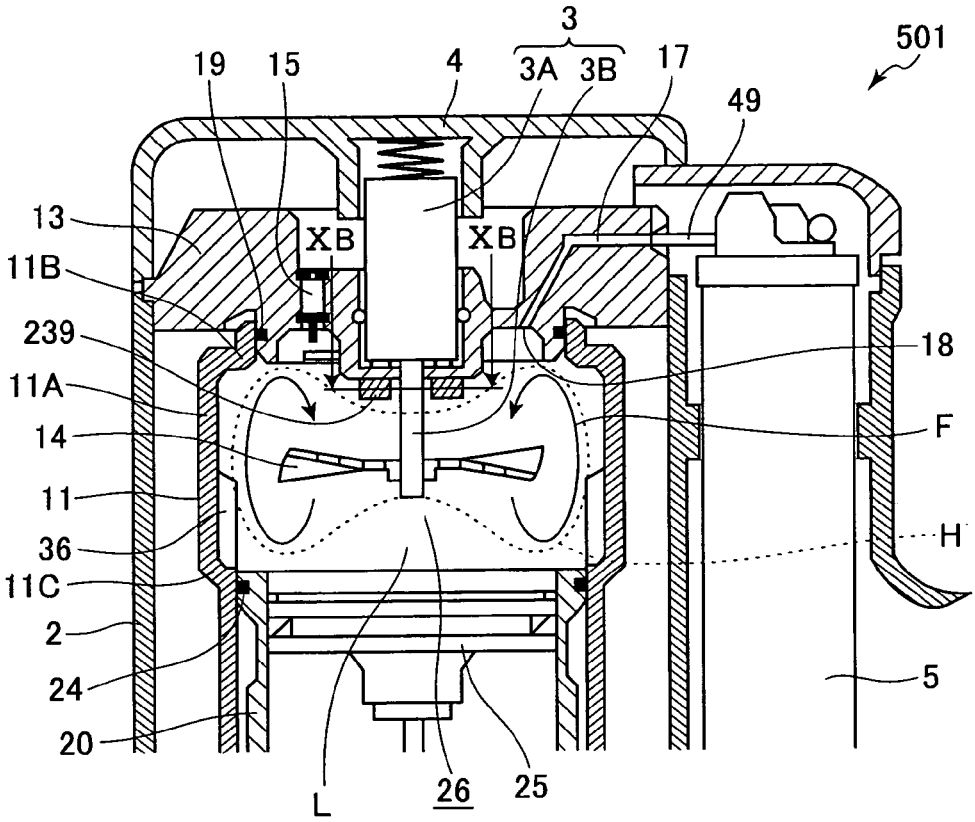
FIG. 10A is a vertical cross-sectional view showing a combustion-type nail driver embodying a combustion-type power tool according to a sixth embodiment of the present invention.
Figure 10B:
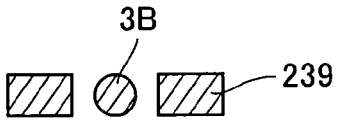
FIG. 10B is a horizontal cross-sectional view taken along a line XB-XB of FIG. 10A for particularly showing an example of a shape of a piston-returning fin.
Figure 10C:
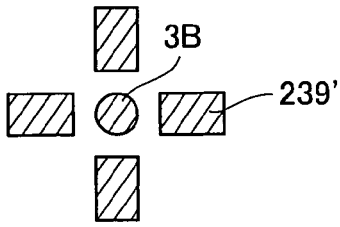
FIG. 10C is a horizontal cross-sectional view taken along a line XB-XB of FIG. 10A for particularly showing another example of the shape of the piston-returning fin.
Figure 10D:
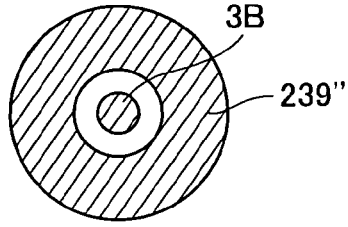
FIG. 10D is a horizontal cross-sectional view taken along a line XB-XB of FIG. 10A for particularly showing another example of the shape of the piston-returning fin.

A combustion-type power tool according to a sixth embodiment of the present invention will be described with reference to FIGS. 10A through 10D. As shown in FIGS. 10A through 10D, a combustion-type nail driver 501 according to the sixth embodiment has a piston-returning fin 239. As shown in FIG. 10A, the piston-returning fin 239 is disposed at the head cap 13 to protrude into the combustion chamber 26. More specifically, the piston-returning fin 239 is disposed at the head cap 13 at a position below the motor case 3A and adjacent to the motor shaft 3B. As shown in FIG. 10A, the piston-returning fin 239 is located within the low turbulent-combustion region L. In other words, an entirety of the piston-returning fin 239 is located within the low turbulent-combustion region L. As shown in FIG. 10B, the piston-returning fin 239 includes two plate-shaped fins located at both sides of the motor shaft 3B. The piston-returning fin 239 may have different shapes. For example, as shown in FIG. 10C, a piston-returning fin 239' includes four plate-shaped fins located around the motor shaft 3B. Alternatively, as shown in FIG. 10D, a piston-returning fin 239" has a hollow cylindrical shape formed around the motor shaft 3B.

Figure 11:
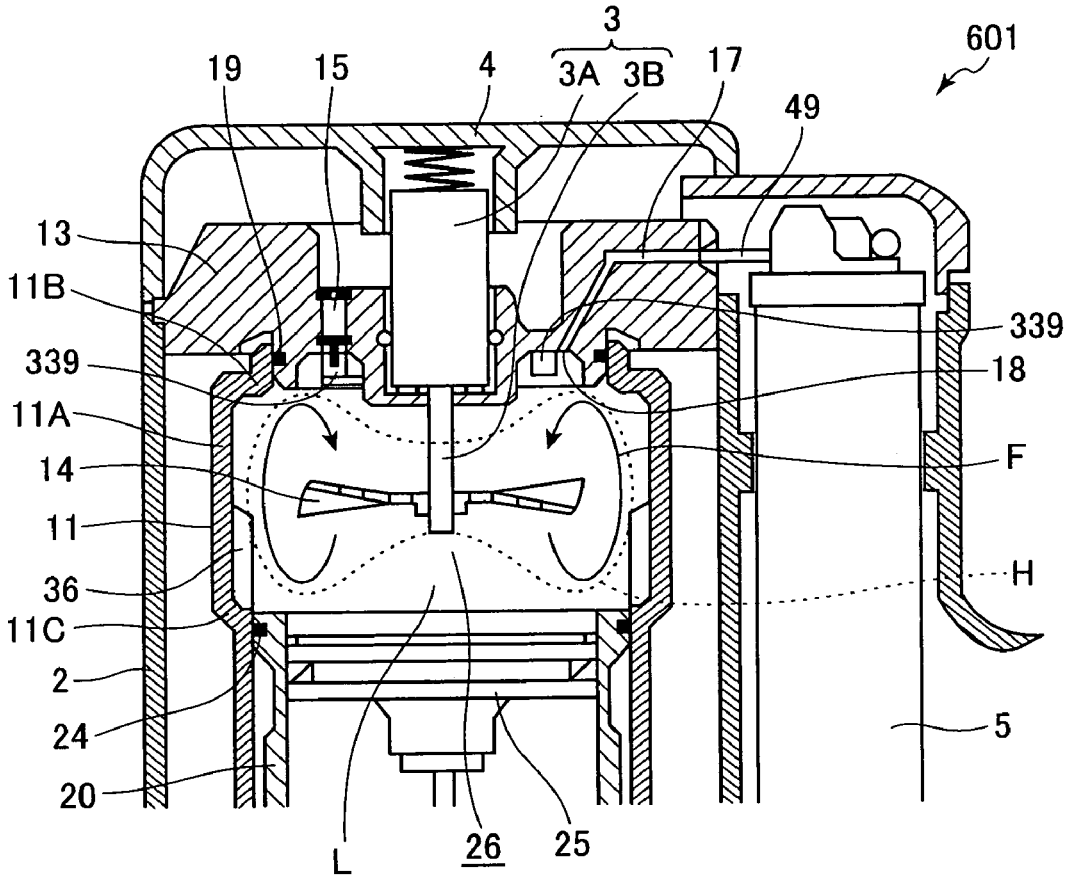
FIG. 11 is a vertical cross-sectional view showing a combustion-type nail driver embodying a combustion-type power tool according to a seventh embodiment of the present invention.

A combustion-type power tool according to a seventh embodiment of the present invention will be described with reference to FIG. 11. As shown in FIG. 11, a combustion-type nail driver 601 according to the seventh embodiment has a piston-returning fin 339. Like the piston-returning fin 239 of the sixth embodiment (FIG. 10A), the piston-returning fin 339 is disposed at the head cap 13 to protrude into the combustion chamber 26. The piston-returning fin 339 in the present embodiment, however, is disposed at a position adjacent to the ignition plug 15 and at a position adjacent to the ejection port 18.

Figure 12A:
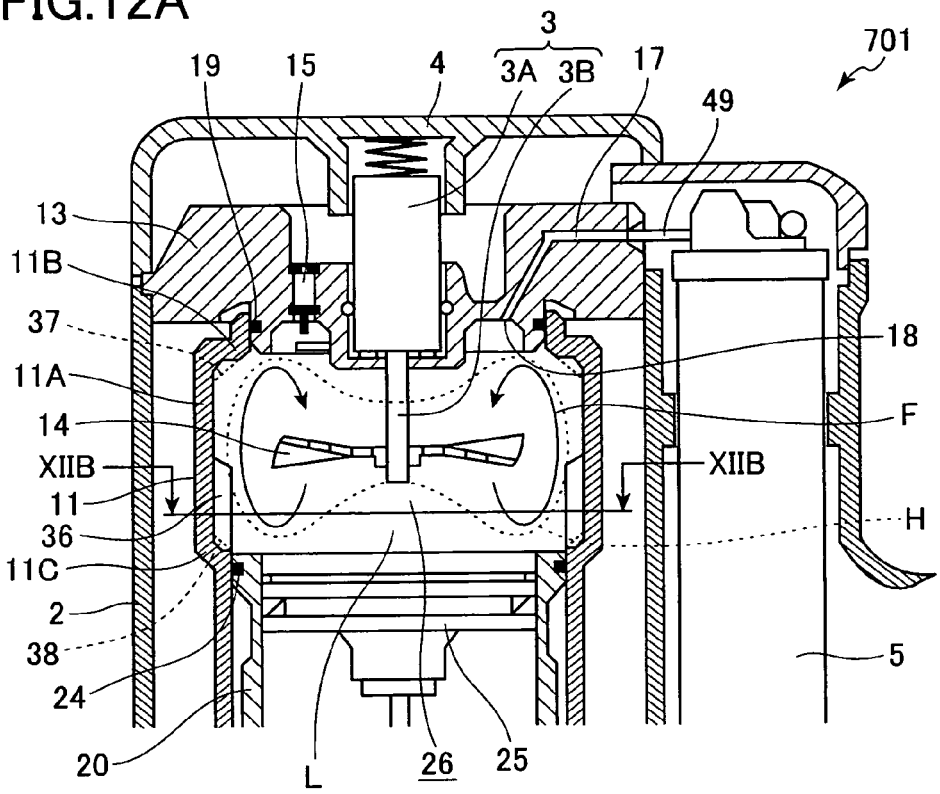
FIG. 12A is a vertical cross-sectional view showing a combustion-type nail driver embodying a combustion-type power tool according to an eighth embodiment of the present invention.
Figure 12B:
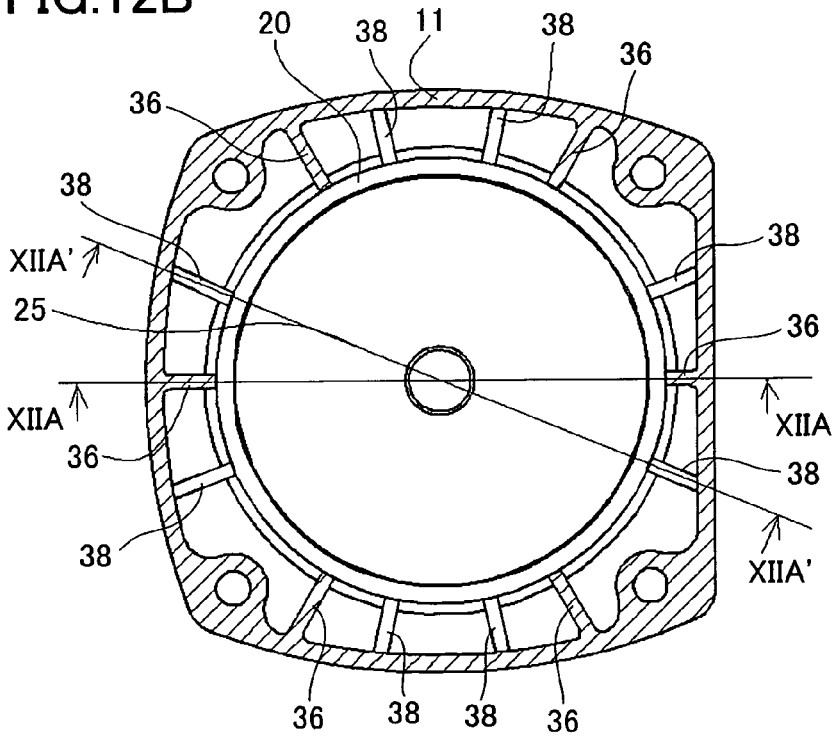
FIG. 12B is a horizontal cross-sectional view taken along a line XIIB-XIIB of FIG. 12A for particularly showing the combustion-chamber fins and the lower fins.

A combustion-type power tool according to an eighth embodiment of the present invention will be described with reference to FIGS. 12A and 12B. FIG. 12A is a vertical cross-sectional view taken along a line XIIA-XIIA of FIG. 12B, and FIG. 12B is a horizontal cross-sectional view taken along a line XIIB-XIIB of FIG. 12A. Note that in FIG. 12A the upper fins 37 and the lower fins 38 are shown in dotted lines because the upper fins 37 and the lower fins 38 are located on a line XIIA'-XIIA' of FIG. 12B. As shown in FIG. 12B, a combustion-type nail driver 701 according to the eighth embodiment has a smaller number of the combustion-chamber fins 36 than the combustion-type nail driver 1 of the first embodiment (FIG. 4). Because the number of the combustion-chamber fins 36 is reduced, the surface area of the combustion-chamber fins 36 is also reduced in the high turbulent-combustion region H. Therefore the combustion-chamber fins 36 do not prevent the gas mixture from combusting and expanding, and thus can suppress a drop in drive energy. Following the turbulent combustion in the high turbulent-combustion region H, the combusted gas expands to the low turbulent-combustion region L and arrives at the upper fins 37 and the lower fins 38. Since the combusted gas is cooled effectively by the upper fins 37 and the lower fins 38, sufficient thermal vacuum can be generated and thus the piston 25 can be reliably moved back to the initial top dead center in the cylinder 20.

While the invention has been described in detail with reference to the specific embodiment thereof, it would be apparent to those skilled in the art that various changes and modifications may be made therein without departing from the spirit of the invention. For example, in the above-described embodiments, the upper fins 37, the lower fins 38, the piston-returning fins 39, 139, 239, and 339 have specific shapes. However, the shapes of these fins may be changed according to the above-described requirements of reducing the drop in drive energy and moving the piston back to the initial position reliably.

What is claimed is:

1. A combustion-type power tool comprising:

a housing having one end and another end;

a head portion disposed at the one end;

a cylinder disposed in the housing;

a push lever disposed at the another end and movable in a longitudinal direction of the housing when pressure contacting a workpiece;

a piston reciprocally movable in the cylinder;

a combustion-chamber frame disposed in the housing and movable in the longitudinal direction in interlocking relation to the push lever, the combustion-chamber frame being abuttable on the head portion to provide a combustion chamber in cooperation with the head portion and the piston;

a fuel supplying portion containing fuel and supplying the fuel into the combustion chamber, thereby providing air-fuel mixture in the combustion chamber;

a motor disposed at the head portion and having an output shaft protruding into the combustion chamber;

a fan disposed in the combustion chamber and connected to the output shaft so as to be rotatable with the output shaft for promoting turbulent combustion of the air-fuel mixture, the fan and the combustion-chamber frame defining, within the combustion chamber, a high turbulent-combustion region in which the turbulent combustion is rapidly generated and a low turbulent-combustion region outside the high turbulent-combustion region;

a fin having one shape and disposed at at least one of the combustion-chamber frame, the head portion, and the piston so as to protrude into the combustion chamber, an entirety of the fin being located within the low turbulent-combustion region; and another fin having another shape different from the one shape, at least a part of the another fin being located in the high turbulent-combustion region.

wherein the fin having one shape is disposed above the blade of the fan.

2. A combustion-type power tool comprising:

a housing having one end and another end;

a head portion disposed at the one end;

a cylinder disposed in the housing;

a push lever disposed at the another end and movable in a longitudinal direction of the housing when pressure contacting a workpiece;

a piston reciprocally movable in the cylinder;

a combustion-chamber frame disposed in the housing and movable in the longitudinal direction in interlocking relation to the push lever, the combustion-chamber frame being abuttable on the head portion to provide a combustion chamber in cooperation with the head portion and the piston;

a fuel supplying portion containing fuel and supplying the fuel into the combustion chamber, thereby providing air-fuel mixture in the combustion chamber;

a motor disposed at the head portion and having an output shaft protruding into the combustion chamber;

a fan disposed in the combustion chamber and connected to the output shaft so as to be rotatable with the output shaft for promoting turbulent combustion of the air-fuel mixture, the fan and the combustion-chamber frame defining, within the combustion chamber, a high turbulent-combustion region in which the turbulent combustion is rapidly generated and a low turbulent-combustion region outside the high turbulent-combustion region;

a fin having one shape and disposed at at least one of the combustion-chamber frame, the head portion, and the piston so as to protrude into the combustion chamber, an entirety of the fin being located within the low turbulent-combustion region; and another fin having another shape different from the one shape, at least a part of the another fin being located in the high turbulent-combustion region;

wherein the fin having one shape is disposed proximate to a center portion of an upper portion of the piston.

3. A combustion-type power tool comprising:

a housing having one end and another end;

a head portion disposed at the one end;

a cylinder disposed in the housing;

a push lever disposed at the another end and movable in a longitudinal direction of the housing when pressure contacting a workpiece;

a piston reciprocally movable in the cylinder;

a combustion-chamber frame disposed in the housing and movable in the longitudinal direction in interlocking relation to the push lever, the combustion-chamber frame being abuttable on the head portion to provide a combustion chamber in cooperation with the head portion and the piston;

a fuel supplying portion containing fuel and supplying the fuel into the combustion chamber, thereby providing air-fuel mixture in the combustion chamber;

a motor disposed at the head portion and having an output shaft protruding into the combustion chamber;

a fan disposed in the combustion chamber and connected to the output shaft so as to be rotatable with the output shaft for promoting turbulent combustion of the air-fuel mixture, the fan and the combustion-chamber frame defining, within the combustion chamber, a high turbulent-combustion region in which the turbulent combustion is rapidly generated and a low turbulent-combustion region outside the high turbulent-combustion region;

a fin having one shape and disposed at at least one of the combustion-chamber frame, the head portion, and the piston so as to protrude into the combustion chamber, an entirety of the fin being located within the low turbulent-combustion region; and another fin having another shape different from the one shape, at least a part of the another fin being located in the high turbulent-combustion region;

wherein the fin having one shape is disposed proximate to a center portion of the head portion.

4. A combustion-type power tool comprising: a housing;

a head portion disposed at one end of the housing;

a cylinder disposed in the housing;

a piston slidably disposed in the cylinder;

a combustion-chamber frame disposed in the housing and movable between a first position and a second position, the combustion-chamber frame being abuttable on the head portion to provide a combustion chamber in cooperation with the head portion and the piston, the combustion-chamber frame including a peripheral wall extending in an axial direction of the cylinder, and upper wall joined to the peripheral wall at one end thereof, and a lower wall joined to the peripheral wall at another end thereof;

a motor disposed at the head portion;

a fan disposed in the combustion chamber and connected to an output shaft of the motor;

a first fin disposed at a joining portion between the peripheral wall and the upper wall of the combustion-chamber frame; and a second fin disposed at a joining portion between the peripheral wall and the lower wall of the combustion-chamber frame.

5. A combustion-type power tool as defined in claim 4, wherein the first fin has one shape and the second fin has another shape different from the one shape.

6. A combustion-type power tool as defined in claim 4, wherein the first fin is further disposed at a joining portion between the peripheral wall and the lower wall of the combustion-chamber frame.

* * * * *